US012635820B1

(12) United States Patent
Hanses et al.

(10) Patent No.: US 12,635,820 B1
(45) Date of Patent: May 26, 2026

(54) FOLDABLE DEVICE FOR GARMENT APPLICATION

(71) Applicant: SHE3 Inc., Kirkland, WA (US)

(72) Inventors: Kristin Lee Hanses, Kirkland, WA (US); Christopher Thomas Bicket, Kirkland, WA (US)

(73) Assignee: SHE3 Inc., Kirkland, WA (US)

( * ) Notice: Subject to any disclaimer, the term of this patent is extended or adjusted under 35 U.S.C. 154(b) by 0 days.

(21) Appl. No.: 19/027,501

(22) Filed: Jan. 17, 2025

(51) Int. Cl.
*A47G 25/90* (2006.01)

(52) U.S. Cl.
CPC ..... *A47G 25/90* (2013.01)

(58) Field of Classification Search
CPC ..... A47G 25/32; A47G 25/90; A47G 25/901; A47G 25/902; A47G 25/904; A47G 25/905; A47G 25/92; B25F 1/04; B26B 1/02; B26B 1/04; B26B 1/042; B26B 1/044; B26B 1/046; B26B 1/048
See application file for complete search history.

(56) References Cited

U.S. PATENT DOCUMENTS 210,228 A * 11/1878 West ..... A47G 25/92 24/40
289,095 A * 11/1883 Havell ..... A47G 25/92 24/40
725,166 A * 4/1903 Sommer ..... A47G 25/92 24/40
1,187,842 A * 6/1916 Kaas ..... B25F 1/04 7/168
1,207,522 A * 12/1916 Fewell ..... A47G 25/92 24/40
1,255,272 A * 2/1918 Anderson ..... A47G 25/92 24/40
1,530,070 A * 3/1925 Bovee ..... A45D 29/20 132/148
1,561,262 A * 11/1925 Martin ..... B26B 11/00 132/148
1,783,346 A * 12/1930 Scully ..... B25G 3/06 7/168
2,089,536 A * 8/1937 Champlin ..... B26B 11/001 81/3.35
3,885,478 A * 5/1975 Evans ..... B67B 7/14 81/3.55
4,040,545 A * 8/1977 Hill ..... A47G 25/32 223/85
4,067,487 A * 1/1978 Carr ..... A44B 19/262 223/111
D415,332 S * 10/1999 Doles ..... D2/643
6,494,512 B1 * 12/2002 Cada ..... A44B 19/262 24/429
6,698,049 B2 * 3/2004 McLoudrey ..... B26B 11/008 7/161

(Continued)

*Primary Examiner* — F Griffin Hall
(74) *Attorney, Agent, or Firm* — BakerHostetler

(57) ABSTRACT

Systems, methods, and apparatuses related to garment application are disclosed. According to embodiments, a garment application device may include a handle, and inner body secured to the handle via a pivot section, and a hook extending from an end of the inner body. The hook may include a point extending in a direction away from an inner, longitudinal edge of the inner body. The garment application device may assist with applying or removing garments without damaging a user and article of clothing.

19 Claims, 6 Drawing Sheets

(56) References Cited

U.S. PATENT DOCUMENTS

| | | | | |
|---|---|---|---|---|
| 7,284,557 | B1 * | 10/2007 | Williams | A45D 24/00 7/168 |
| 9,386,875 | B2 * | 7/2016 | Clifton | A47G 25/905 |
| 9,999,311 | B1 * | 6/2018 | Penso | A47G 25/902 |
| 12,304,049 | B2 * | 5/2025 | Sarama | B25F 1/04 |
| 2015/0190006 | A1 * | 7/2015 | Fowler | A47G 25/908 223/113 |
| 2020/0384626 | A1 * | 12/2020 | Lopez | B25F 1/006 |

* cited by examiner

FOLDABLE DEVICE FOR GARMENT APPLICATION

TECHNICAL FIELD

The present disclosure generally relates to garments, and more particularly, to garment application systems and devices.

BACKGROUND

The application of tight-fitting garments such as sports bras, athletic vests designed to hold GPS trackers, and other form-fitting clothing poses significant kinesthetic challenges for the wearer. Many garments, especially those designed for athletic pursuits, are deliberately designed to fit tightly to provide muscle support, to reduce muscle vibrations during exercise, to securely hold GPS trackers close to the body during exercise, and to otherwise enhance performance and reduce the risk of injury to the wearer. However, the design can make the process of putting on or taking off the garment difficult-particularly for individuals with disabilities or limited upper-body mobility, flexibility, or strength. For example, pulling a sports bra or athletic vest over the head and maneuvering it into place without the assistance of another person or tool involves reaching under and around the back, adjusting the fabric, and pulling it downward-a sequence of movements that can be cumbersome, physically demanding, and in some instances, kinesthetically impossible.

In some cases, the challenge is exacerbated by the need to ensure particular positioning and support, which can require additional adjustments after the garment is partially donned. Clothing adjustments along one's back can be particularly difficult to execute. Similarly, individuals recovering from surgery, those with joint or muscle pain, or older adults may find the physical effort required to don these garments prohibitive. This difficulty is further compounded when the garment's material resists sliding against the skin or becomes twisted during the process. A companion might be of assistance, but companions are unavailable or unwelcome, particularly given the intimate situses at issue.

An effective solution would not only reduce physical strain and time required for garment application but also improve accessibility and independence for users facing such difficulties.

SUMMARY

Disclosed herein are systems, methods, and apparatuses for a garment application device. In examples, embodiments may include a handle, an inner body secured to the handle via a pivot section, and a hook extending from an end of the inner body that is opposite the pivot section. In examples, the handle includes an opening along a longitudinal edge. The inner body is rotatable between a closed position and an open position. In the closed position, the inner body may be secured within the opening along the longitudinal edge. The hook may include a point extending in a direction away from an inner, longitudinal edge of the inner body.

According to various examples, the hook may have a throat length that is less than a gap length. The hook may also include at least one of a dull point and a rounded point. In additional examples, the point of the hook may have a greater width than a bend of the hook. The opening of the hook may be positioned in a direction opposite to a direction of the inner body when transitioning from the closed position to the open position.

The pivot section may include a base and a pin, wherein the base is positioned through a hole on the handle and a hole on the inner body, and wherein the pin is positioned on an opposite side of the hole of the handle, and wherein the pin is locked into a pin receiving section of the base. The hole on the handle may include at least one inner ledge upon which the pin and the base biases against so that an outer section of the pin and the outer section of the base is flush with a surface of the handle. The base may further include a bottom plate, a raised portion extending from the bottom plate, and wherein the pin receiving section comprises at least one internal, lateral recess to receive the pin. The pin may include a laterally extending end secured within the at least one internal, lateral recess. The raised portion may include at least one protrusion extending from a vertical side of the raised portion, and wherein the at least one protrusion interlocks with at least one respective groove on an inner portion of the hole the inner body. The pin may snap fit into the pin receiving section to secure the handle and the inner body.

In various examples, an edge may be formed on a rear, longitudinal side of the inner body, and a detent may be provided on or within a base of the handle. The edge and the detent determine a maximum rotation of the inner body relative to the handle.

Additionally, aspects may include a hole extending through the pivot section, for example, for a lanyard, rope, tie, or other device. The handle may also include a cutout on a side opposite the longitudinal edge, A section of the inner body may be accessible to initiate a transition of the inner body from the closed position to the open position.

A section of the inner body may include an overmold material. The hook section may include an overmold material. The overmold material may surround the point and an inner bend of the hook. In various examples, the overmold material comprises at least one of silicone and a rubber.

These and other features will be more clearly understood from the following detailed description taken in conjunction with the accompanying drawings and claims. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION OF ILLUSTRATIVE EMBODIMENTS

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Garment application devices, systems, and methods discussed herein may be particularly applicable to individuals who face challenges in putting on or removing clothing. The device's ergonomic design ensures that users can effectively manage their garments without requiring significant physical dexterity or flexibility. This is especially beneficial for individuals with limited mobility, the elderly, or those recovering from surgery, as the device extends their reach and provides additional leverage.

Aspects of various embodiments include a foldable body and specially designed hook portion, which can be compactly stored within the main body. This folding mechanism not only enhances portability but also ensures that the device is lightweight, space-efficient, and storage safe. Users can conveniently carry the device, making it accessible whenever needed. The case of storage and transportation significantly increases the device's usability in various settings, from home to travel.

Figure 1:
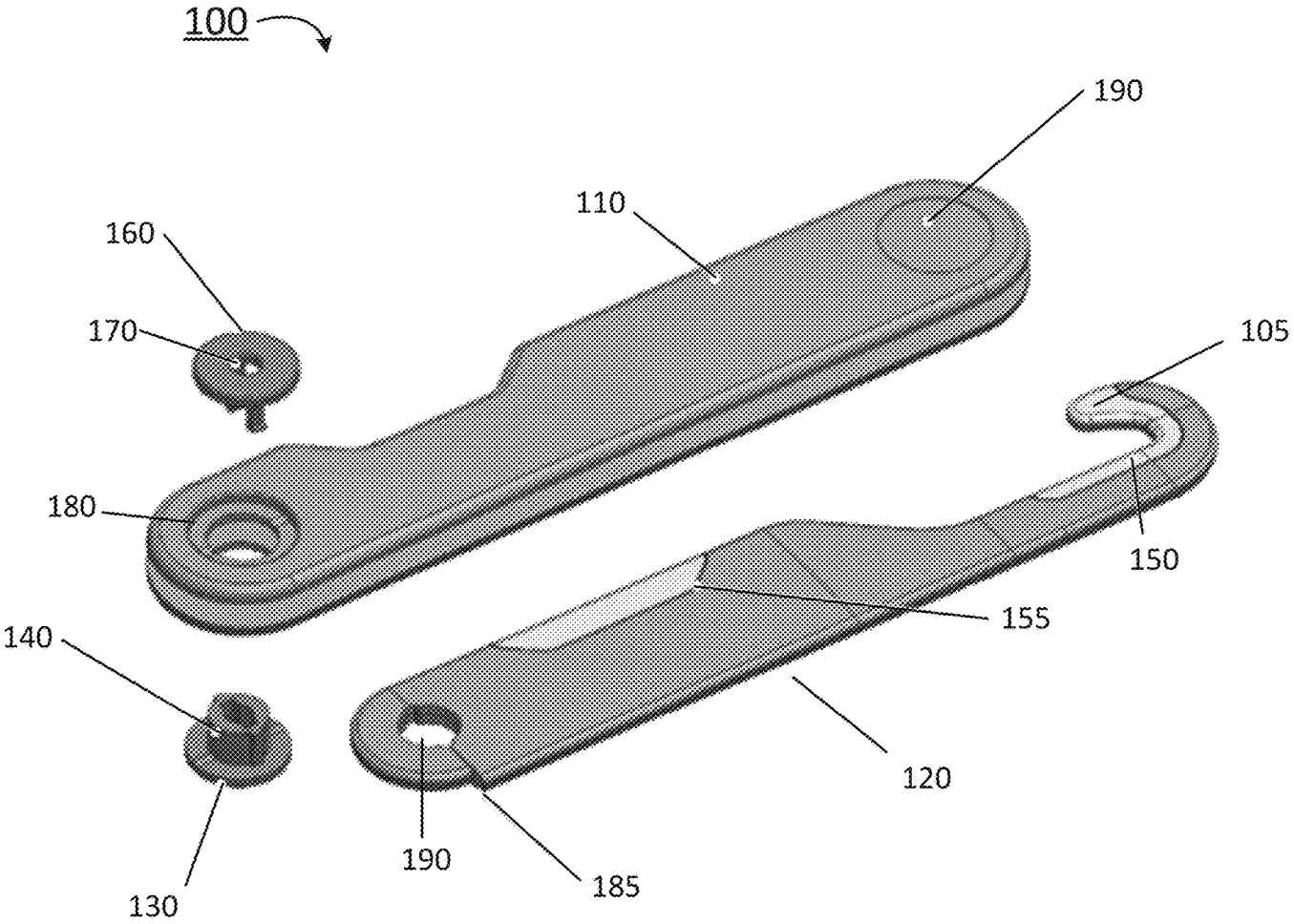
FIG. 1 is a perspective view of a garment application device, in accordance with an embodiment.

FIG. 1 illustrates an example a garment application device 100. The garment application device 100 may assist users with applying, adjusting, or removing clothing garments. The inner body and hook portion may be foldable into the handle to create a lightweight, space efficient device that can be stored, for example, in a purse, gym bag, desk drawer, pocket, or other container. The garment application device can be easily opened to provide a hook specifically designed for use with clothing. In various examples, the hook is rounded or otherwise not sharp and may have a flattened or dull end point so as to not cause damage to the user or to clothing garments. The hook provides safety and functionality, having a distinct shape to easily grab clothing (e.g., straps, sports bra bands, swimsuits, wetsuits, uniforms, tights, tight-fitting shirts, leggings, pants, tracker vest linings, etc.) and common clothing materials (e.g., cotton, polyester, nylon, etc.) to assist with putting on or taking off clothing without damage. The garment application device 100 can help extend a user's reach and leverage to grasp clothing on a user's backside. In some examples, the garment application device may assist with pulling down a strap, such as a sports bra strap, reach a twisted or tangled portion of material, and assist with taking such pieces off.

This garment application device is versatile and suitable for a wide range of clothing garments for both men and women. Examples include assisting with the application or removal of sports bras, tank tops, dresses, swimsuits, wetsuits, shirts, and jackets for women. For men, it can help with items such as undershirts, ties, vests, wetsuits, and jackets. In addition to clothing, the device can be used for other applications such as reaching for or adjusting accessories like belts, scarves, and hats.

The ergonomic design of the device ensures that users can manage their accessories without requiring significant physical dexterity or flexibility. This is particularly beneficial for individuals with limited mobility, the elderly, or those recovering from surgery. Moreover, the device is also useful for reaching and adjusting various personal items such as bags and backpacks, which can be difficult to handle for those with limited reach. The hook can be used to grab items inside a bag, making it easier to organize and retrieve belongings. Additionally, it can help in positioning and managing long necklaces or chains, ensuring they are worn comfortably and securely. The garment application device can be a tool not only for clothing but also for a myriad of accessories, enhancing its practicality and usability in everyday life.

The garment application device includes a main body 110 and an inner body 120 that can fold into the main body through an opening (see FIG. 4B and opening 830 of FIG. 8) on a longitudinal side of the main body. The main body 110 may be a handle that a user can hold while operating the garment application device. The main body 110 and the inner body 120 are connected via a pivot section, which may include a base 130 and a pin section 160 that snap fits into the base (see also, FIGS. 7-8). In an example, top surface of pin section 160 may include a hole 170 extending through the body of the pin, to provide a lanyard hole through the pivot section. In such examples, the base 130 also has a hole through which a lanyard, or other rope or tie device, may be fed through.

The pivot section (e.g., including base 130 and pin section 160) may connect an end section of the main body 110 and an end section of the inner body 120, while still allowing movement of the inner body 120 relative the main body 110. Accordingly, the main body 110 and inner body 120 may pivot at the pivot section to transition between a closed position, wherein the inner body is housed within the main body 110, and an open position, wherein the inner body 120 is extended.

In various examples, at least one of the pin 160 and base 130 of the pivot section may include a circular portion that will sit on an inner ledge within an opening 180 of the main body, to secure a position of the pivot section. The inner ledge(s), pin, and base may also be formed so that the outer surface of the base 130 and/or the outer section of the pin 160 will be flush with an outer surface of the main body.

The base 130 may also include an extended portion 140, which protrudes through both the opening 180 of the main body 110 and an opening 190 of the inner body 120. The extended portion 140 may include an interlocking feature to connect the base section with the inner body 120 and will rotate with the inner body as it transitions between the open and closed positions. The extended portion may have one, two, or more protrusions extending from a vertical side of the extended portion. The protrusions position the pivot section to connect the main body 110 and inner body 120 (e.g., interlocking the pieces).

A detent on the main body 110 (see, e.g., detent 810 in FIG. 8) may be provided to determine how far the inner body 120 may extend relative to the main body 110 when the device is in the open position. At least one lateral protrusion may serve as a detent to prevent the inner body 120 from extending past a certain position. The detent may be positioned to contact a part of the inner body 120, such as edge 185 of the inner body, when a particular distance is met. For example, the detent may be aligned with the edge 185 to prevent the inner body 120 from extending past 180 degrees from the closed position. The edge 185 may be particularly shaped to contact the protrusion at a desired endpoint, such as a maximum extension angle. The edge 185 and detent may further serve to provide leverage and force to keep the hook open and sturdy during operation. For example, a user reaching behind their back to pull down an article of clothing with the hook would create a torque on the inner body relative too the pivot section. The torque biases the edge 185 against the detent, and the device remains open, with very little effort on behalf of the user, and enabling the user to use the device 100 to pull down the article of clothing.

A hook 105 can extend off an end of the inner body. In examples, the hook may have an overmold 150 positioned on the point and front side of the bend and body of the hook. The overmold 150 may be one or more separate piece that are snap fit onto the inner body 120. An overmold 150 may include the point, the front side of the bend, and the front side of the body of the hook. In such examples, the snap fit overmold may provide a hook shape for a variety of preferences and applications. In another example, a body overmold 155 may be placed along a longitudinal side, such as an inner longitudinal side of the inner body 120. In some examples, the body overmold 155 is accessible through a cutout on the main body 110 (see also FIG. 6) and indicates an area where a user may press to initiate a transition between the closed position and the open position. In examples, the body overmold 155 helps to make the force against the inner body 120 more comfortable for the user, while also indicating the effective place to provide the force needed to open the device.

The hook 105 may be shaped to easily catch onto a piece of clothing, garment, or other material, without causing damage to the item of to the user. The point (i.e., end) of the hook may be rounded, flat, or another dull shape to avoid scratching a user's skin or causing holes and other damage to the item being grasped. Additionally, in various embodiments, the hook orientation may be reversed, depending on a desired application, user preference or the like. For example, the inner body may be oriented in the reverse direction, to have the hook facing the opposite direction.

Figure 2:
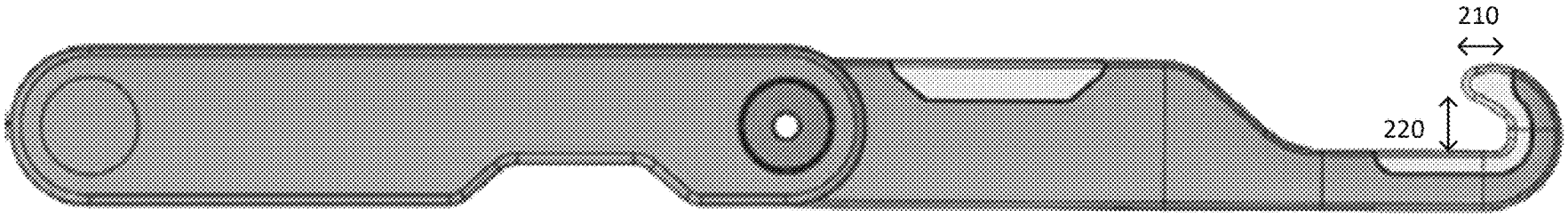
FIG. 2 is a garment application device in an open position, in accordance with an embodiment.

In various examples, as best seen in FIG. 2, the throat length 220 of the hook may be less than a gap length 210 of the hook. Throat length refers to the distance between the top of the hook's opening (near the base of the hook or shank) and the deepest part of the hook's curve or "bight." The throat length helps to determine the amount of space available for accommodating the load or object being hooked. A longer throat length allows for larger or thicker items to be hooked but may affect the hook's load distribution and capacity. The gap length, also referred to as the hook opening width, is the horizontal distance between the top o the hook and the inner edge of the throat. The gap length helps determine how wide an object can be for the hook to engage.

The throat and gap length of present embodiments helps create a greater angle of grasp for the hook, especially when the device is being used to grasp an article along a user's back, where reach and leverage may be difficult due to positioning and mobility considerations of the individual. In an example, the point of the hook may also be angled away from the longitudinal axis of the inner body 120 (e.g., the shank portion of the hook) such that the angle between the point of the hook and the longitudinal axis is greater than 90 degrees. This shape is particularly different from traditional hooks, which have a 90 degree or less bend in the hook, in order to pierce and hold an item.

In additional examples, the point of the hook may have a greater width and/or thickness than the bend portion of the hook, to additionally assist with grasping material while being comfortable against the skin of the user. As discussed herein an example use of the garment application device is to assist a user in pulling down an article of clothing material on the user's back, such as the upper back and shoulder area, which is an area that is difficult for many people to reach. The size, thickness, material, and orientation of the hook, and particularly the point of the hook, must be comfortable and safe for the user during such applications.

Figure 3B:
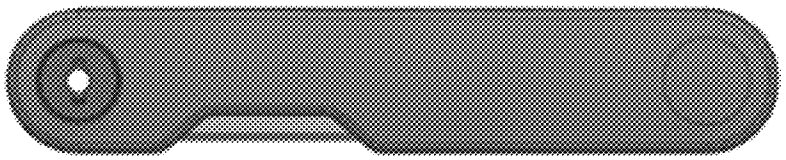
FIG. 3B shows a bottom view of a garment application device in accordance with an embodiment.
Figure 3A:
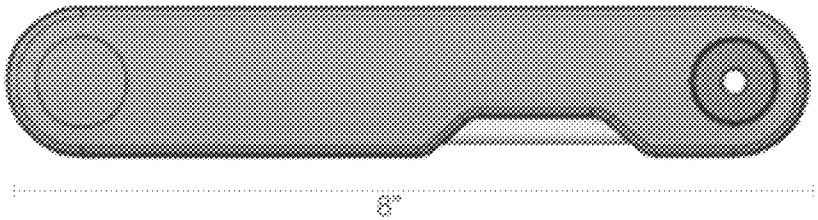
FIG. 3A shows a top view of a garment application device in accordance with an embodiment.

FIGS. 3A and 3B show, respectively, a top view and a bottom view of a garment application device (e.g., garment application device 100) in the closed position. As discussed above, a section of the inner body 120 (e.g., overmold 155) may be visible and accessible through the outer body. The accessible section may be pushed to with a force to overcome the tension provided by the pivot section, to transition the device from the closed position to the open position (see FIG. 2 for the open position). In examples, the pivot section provides at least enough tension to prevent the inner body from unintentionally opening into the open position.

In some examples, a length of the device in the open position (FIG. 2) may be about 14.5". The device may have a length of about 8" when in the closed position. The width of the device may be about 1.5" and a thickness of the device may be around 0.5." It should be appreciated that various lengths, sizes, shapes, and designs may be applied, depending on design and user preference.

Figure 4B:
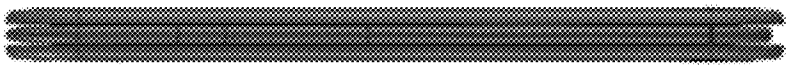
FIG. 4B shows a front side view of a garment application device in the closed position in accordance with an embodiment.
Figure 4A:
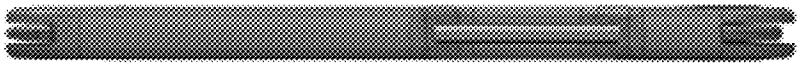
FIG. 4A shows a rear side view of a garment application device in the closed position in accordance with an embodiment.
Figure 5:
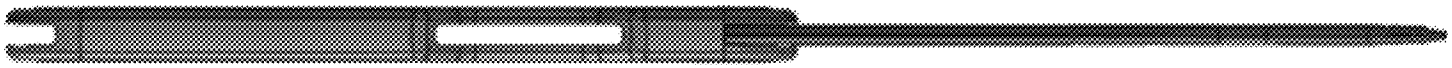
FIG. 5 shows a rear side view of a garment application device in the open position, in accordance with an embodiment.

FIGS. 4A and 4B show, respectively, a rear side view and a front side view of a garment application device in a closed position. In FIG. 4A, an overmold section of the inner body (e.g., overmold 155) may be visible and accessible. A portion of the hook section (e.g., hook 105) may also be visible from the rear side view. The front side view of FIG. 4B illustrates the positioning of the inner body within the main body of the device. As noted above, the thickness of the device may be about 0.5". FIG. 5 illustrates a rear side view, similar to FIG. 4A, but in the open position, with the inner body extended outward.

Figure 6:
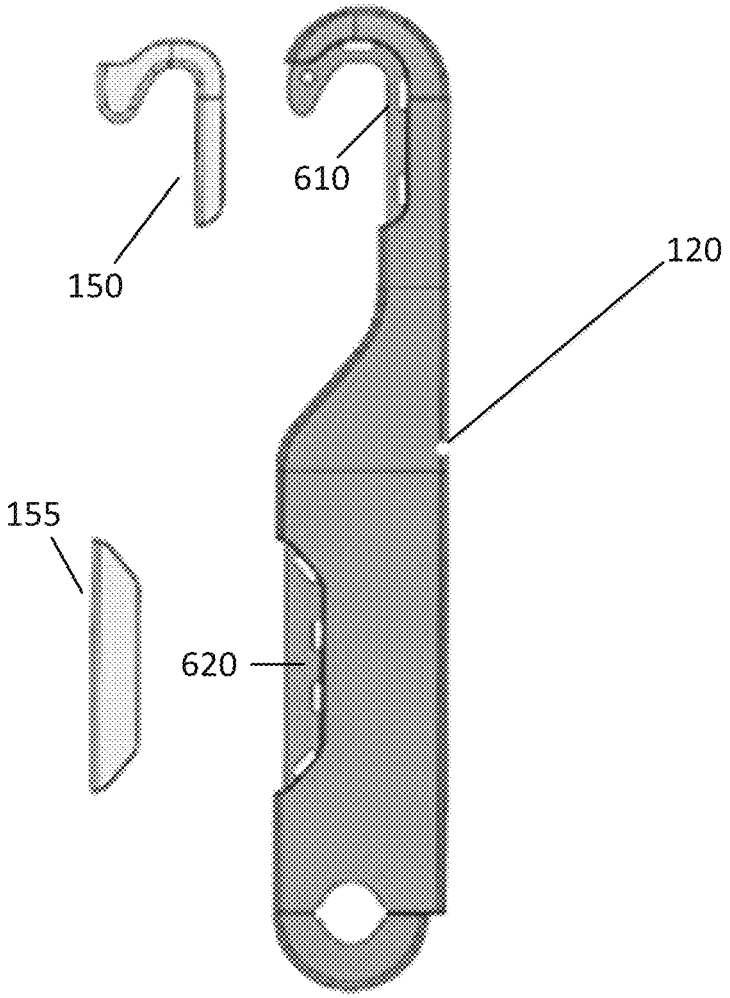
FIG. 6 illustrates overmolds, in accordance with an embodiment.

FIG. 6 illustrates an exploded, top view of a device in the opened position, with overmolds (e.g., overmolds 150, 155). The overmolds may be independent sections designed to secure to a respective portion of the inner body. In examples, overmolds may be snap fit onto a receiving portion of the inner body. As seen in FIG. 6, overmold 150 fits onto hook portion 610, and overmold 155 fits onto body portion 620.

As discussed herein, overmolds may be applied to increase user comfort when using the device. In examples, the overmolds may comprise a material different than the inner body 120. For example, the overmold material may be selected based on softness, grip, durability, and resistance to environmental factors. Such materials may include, but are not limited to silicone, rubber, thermoplastic elastomers, thermoplastic polyurethanes, neoprene, polyolefin elastomers, viton or fluroclastomers, and nitrile rubber. The inner body material may be a hard, durable plastic or polymer such as polypropylene, polyethylene (high density polyethylene or low density polyethylene), polycarbonate blends, and the like.

In various examples, the device may include detachable covering formed at the tip of the hook, designed with options like a dull point or a rounded tip to prevent damage to garments and skin. This covering may be formed using soft-touch materials, such as silicone and rubber, ensuring a gentle interaction with clothing and skin. In various embodiments, the detachable covering may for an ergonomic grip (e.g., fit onto body portion 620) that provides enhanced control when applying or removing garments. The detachable covering may allow additional flexibility and customization, allowing for various hook lengths to accommodate different garment types, user sizes, and user preferences. The variations may help to ensure that delicate fabrics, such as silk or lace, are not torn or snagged during the application or removal process. The soft materials also offer a comfortable experience for the user, reducing the risk of skin abrasions or discomfort.

In examples, alternate shapes for the detachable covering could include a spoon-like shape, which distributes pressure evenly across a larger surface area, reducing the risk of fabric damage. Another option could be a flat, paddle-shaped covering that can slide smoothly under garments without catching on seams or embellishments. Additionally, a looped design could be used to hook and pull-down clothing gently, providing a secure grip without sharp edges that might harm the fabric or the user's skin.

Figure 7:
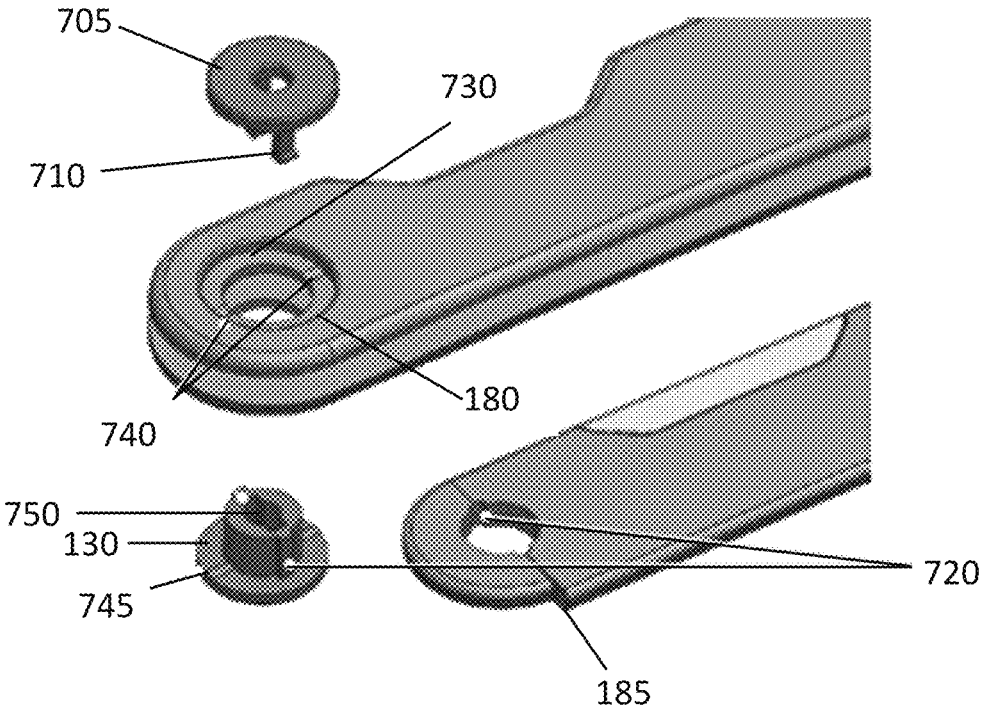
FIG. 7 illustrates a pivot section in accordance with an embodiment.
Figure 8:
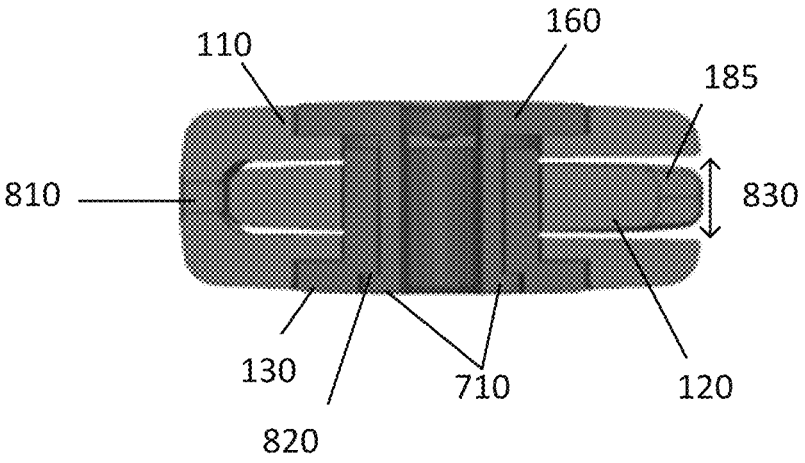
FIG. 8 illustrates a cross-sectional view of a pivot section in accordance with an embodiment.

FIG. 7 illustrates an example pivot section, and FIG. 8 illustrates a cross-sectional view of the pivot section in accordance with embodiments. The opening on the main body may include an inner ledge 730 upon which a head 705 of the pin section sits. The ledge 730 and the pin section may be sized such that the top portion of the head 705 is flush against an outer surface of the main body. A similar ledge may be provided in the opposite (e.g., bottom) outer face of the main body. The ledge 730 may include one or more grooves 740 to assist in receiving the pin section and base section in the proper orientation and align the pin section so that it works with the detent and edge, as discussed herein, to control the alignment of the main body and inner body when in the open and closed positions. The pin section may include one or more pin protrusions have a bent, curved, or otherwise laterally extending end 710 to interlock with a respective lateral recess (see, e.g., recess 820) on the base section 130. The pin section inserts into a pin slot 750 on a top side of the extended portion 140, and the laterally extending end 710 inserts into its respective recess 820 to thereby lock the base section and the pin section together.

An interlock 720 connects the base portion to the inner body. In some examples, the interlock 720 includes at least one protrusion from a vertical section of the extended portion 140 of the base, to sit in a respective groove on the inner portion of the inner body opening 190. The protrusion interlocks with a respective groove, such that the base section 130 rotates along with the inner body, during transitions of the inner body between the open and closed positions.

The grooves 740 may further assist with keeping the inner body secure when in the closed position, by interacting with one or more ridges that may be present on an underside of the head 705. Similarly, a ridge 745 on a top portion of the base section may sit within one or more grooves on a bottom portion of the respective ledge within the bottom, outer face of the main body. The groove and ridge design may assist with keeping the device in the open or closed position until a minimum force is met to release the ridge from the groove and thereby transition the device from one position to the other. The sizing of the ridge and/or groove may be modified to make the transition force greater or less, depending on design preference.

As best seen in FIG. 8, which shows a device in the closed position, a detent 810 may be provided to assist with controlling a maximum rotation of the inner body relative to the main body. The detent 810 may be a part of the main body 110. In some examples, the detent 810 is part of a back edge of the main body, and otherwise positioned on or within a base section of the main body. When the inner body rotates through the longitudinal axis opening 830 of the main body, into the open position, the edge 185 of the inner body may contact detent 810 when a maximum rotation or maximum distance is reached, for example 180 degrees. It should be appreciated that the detent 810 may be formed in alternate positions to make the opening position greater or less than 180 degrees. Additionally, the detent may be formed on one or more features or components discussed herein, such as on the base 130, pin section 160, and the like.

Figure 9:
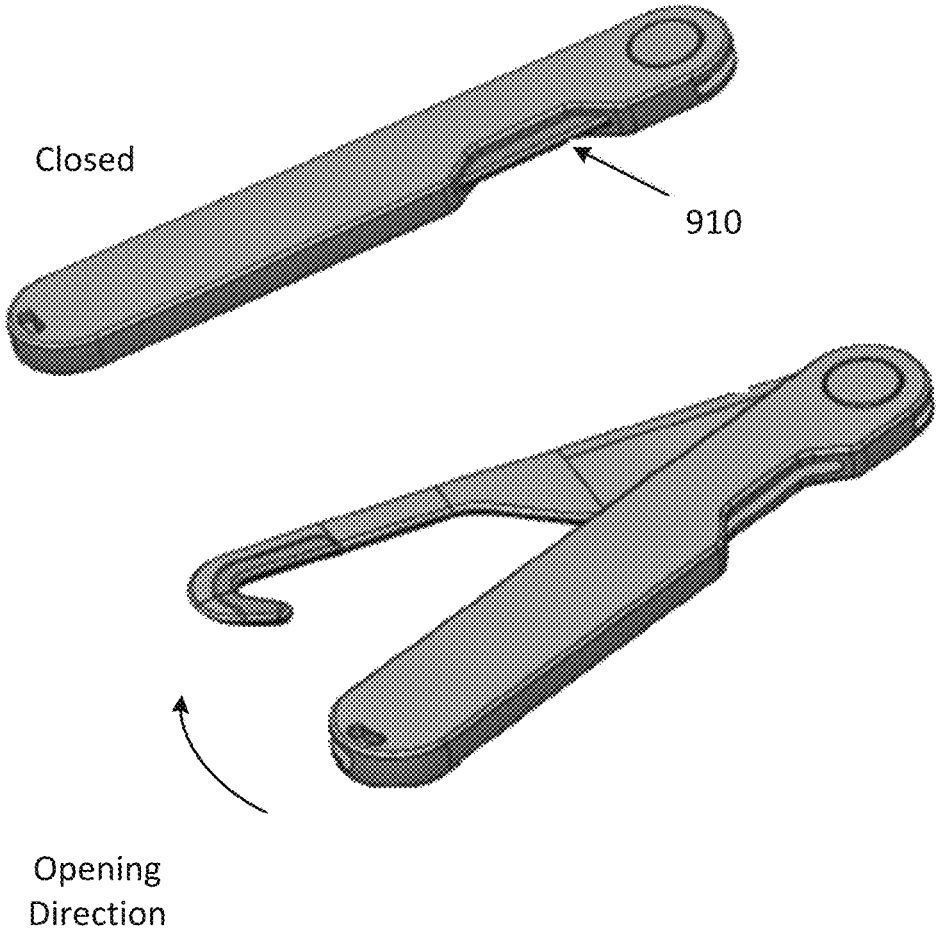
FIG. 9 illustrates a transition between closed position and an open position in accordance with an embodiment.

FIG. 9 illustrates a transition between closed position and an open position in accordance with an embodiment. As discussed herein, in the closed position the inner body, including the hook section, is contained within the main body. A force, pressure, or push may be provided on a section 910 to initiate a transition to the open position. The section 910 may be a part of the inner body, such as a front edge, which is accessible during the closed position. The section 910 may include an overmold or other soft touch material. Once the appropriate force is provided, the device may open in the direction of pressure, into the open position.

To close the device, the reverse operation may be applied. Pressure may be provided on an opposite side of the inner body, such as a back edge, and the inner body may be rotated back through the opening of the main body to close the device. In various examples, the opening of the hook is in a direction opposite to a direction of the inner body when transitioning from the closed position to the open position. This orientation may assist with shielding the hook portion during the closed position, and ensuring a safer transition when opening the device.

In an embodiment, a garment application device comprises a handle comprising an opening along a longitudinal edge; an inner body secured to the handle via a pivot section, wherein the inner body is rotatable between a closed position and an open position, and wherein, in the closed position, the inner body is secured within the opening along the longitudinal edge; and a hook extending from an end of the inner body that is opposite the pivot section, wherein the hook comprises a point extending in a direction away from an inner, longitudinal edge of the inner body.

In an embodiment wherein the hook comprises a throat length that is less than a gap length.

In an embodiment, wherein the hook comprises at least one of a dull point and a rounded point.

In an embodiment, wherein the point of the hook has a greater width than a bend of the hook.

In an embodiment, wherein the pivot section comprises a base and a pin, wherein the base is positioned through a hole on the handle and a hole on the inner body, and wherein the pin is positioned on an opposite side of the hole of the handle, and wherein the pin is locked into a pin receiving section of the base.

In an embodiment, wherein the hole on the handle comprises at least one inner ledge upon which the pin and the base biases against so that an outer section of the pin and the outer section of the base is flush with a surface of the handle.

In an embodiment, wherein the base comprises a bottom plate, a raised portion extending from the bottom plate, and wherein the pin receiving section comprises at least one internal, lateral recess to receive the pin.

In an embodiment, wherein the pin comprises a laterally extending end secured within the at least one internal, lateral recess.

In an embodiment, wherein the raised portion comprises at least one protrusion extending from a vertical side of the raised portion, and wherein the at least one protrusion interlocks with at least one respective groove on an inner portion of the hole the inner body.

In an embodiment, wherein the pin snap fits into the pin receiving section to secure the handle and the inner body.

In an embodiment, further comprising an edge formed on a rear, longitudinal side of the inner body, and a detent on a base of the handle, wherein the edge and the detent determine a maximum rotation of the inner body relative to the handle.

In an embodiment, further comprising a hole extending through the pivot section.

In an embodiment, wherein the handle comprises a cutout on a side opposite the longitudinal edge, and wherein a section of the inner body is accessible to initiate a transition of the inner body from the closed position to the open position.

In an embodiment, wherein the section of the inner body comprises an overmold material.

In an embodiment, wherein the hook comprises an overmold material surrounding the point and an inner bend of the hook.

In an embodiment, wherein the overmold material comprises at least one of silicone and a rubber.

In an embodiment, wherein an opening of the hook is in a direction opposite to a direction of the inner body when transitioning from the closed position to the open position.

In an embodiment, a garment application device may comprise: a handle; an inner body secured to the handle via a pivot section; a curved portion extending from an end of the inner body; and a detachable covering formed at the tip of the hook, wherein the detachable covering comprises at least one of a dull point and a rounded tip to prevent damage to garments and skin.

In an embodiment, wherein the detachable covering comprises a hook shape formed from at least one of at least one of a soft-touch material, silicone, and rubber.

In an embodiment, wherein the detachable covering is snap fit onto the curved portion.

As previously noted, the various features and processes described above may be used independently of one another or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claimed is:

1. A garment application device, comprising a handle comprising an opening along a longitudinal edge;

an inner body secured to the handle via a pivot section, wherein the inner body is rotatable between a closed position and an open position, and wherein, in the closed position, the inner body is secured within the opening along the longitudinal edge, wherein the inner body has a length and a width that is, respectively, substantially equal to a length and a width of the handle;

a hook extending from an end of the inner body that is opposite the pivot section, wherein the hook comprises a point extending in a direction away from an inner, longitudinal edge of the inner body; and a detachable overmold formed of a soft-touch material, wherein the detachable overmold surrounds the point, an inner bend of the hook, and a front longitudinal side of the inner body, and wherein a top side of the hook and a rear longitudinal side of the inner body are formed of a same rigid material as the handle.

2. The garment application device of claim 1, wherein the hook comprises a throat length that is less than a gap length.

3. The garment application device of claim 1, wherein the hook comprises at least one of a dull point and a rounded point.

4. The garment application device of claim 1, wherein the point of the hook has a greater width than a bend of the hook.

5. The garment application device of claim 1, wherein the pivot section comprises a base and a pin, wherein the base is positioned through a hole on the handle and a hole on the inner body, and wherein the pin is positioned on an opposite side of the hole of the handle, and wherein the pin is locked into a pin receiving section of the base.

6. The garment application device of claim 5, wherein the hole on the handle comprises at least one inner ledge upon which the pin and the base biases against so that an outer section of the pin and an outer section of the base is flush with a surface of the handle.

7. The garment application device of claim 5, wherein the base comprises a bottom plate, a raised portion extending from the bottom plate, and wherein the pin receiving section comprises at least one internal, lateral recess to receive the pin.

8. The garment application device of claim 7, wherein the pin comprises a laterally extending end secured within the at least one internal, lateral recess.

9. The garment application device of claim 7, wherein the raised portion comprises at least one protrusion extending from a vertical side of the raised portion, and wherein the at least one protrusion interlocks with at least one respective groove on an inner portion of the hole the inner body.

10. The garment application device of claim 7, wherein the pin snap fits into the pin receiving section to secure the handle and the inner body.

11. The garment application device of claim 1, further comprising an edge formed on a rear, longitudinal side of the inner body, and a detent on a base of the handle, wherein the edge and the detent determine a maximum rotation of the inner body relative to the handle.

12. The garment application device of claim 11, wherein a section of the inner body comprises an overmold material.

13. The garment application device of claim 1, further comprising a hole extending through the pivot section.

14. The garment application device of claim 1, wherein the handle comprises a cutout on a side opposite the longitudinal edge, and wherein a section of the inner body is accessible to initiate a transition of the inner body from the closed position to the open position.

15. The garment application device of claim 1, wherein the detachable overmold material comprises at least one of silicone and a rubber.

16. The garment application device of claim 1, wherein an opening of the hook faces a direction opposite to a direction of rotation of the inner body during rotation of the inner body about the pivot section when transitioning from the closed position to the open position.

17. A garment application device comprising:

a handle;

an inner body secured to the handle via a pivot section, wherein the inner body has a length and a width that is, respectively, substantially equal to a length and a width of the handle;

a hook extending from an end of the inner body; and a detachable covering formed at a tip of the hook, wherein the detachable covering comprises at least one of a dull point and a rounded tip, wherein the detachable covering is formed of a soft-touch material, wherein the detachable covering surrounds the tip, an inner bend of the hook, and a front longitudinal side of the inner body, and wherein a top side of the hook and a rear longitudinal side of the inner body are formed of a same rigid material as the handle.

18. The garment application device of claim 17, wherein the detachable covering comprises a hook shape formed from at least one of at least one of silicone, and rubber.

19. The garment application device of claim 17, wherein the detachable covering is snap fit onto the hook.

* * * * *